US006840577B2

(12) United States Patent
Watkins

(10) Patent No.: US 6,840,577 B2
(45) Date of Patent: Jan. 11, 2005

(54) ADJUSTABLE FOLDING PLANAR SEAT

(75) Inventor: Mervyn M. Watkins, Rancho Palos Verdes, CA (US)

(73) Assignee: Convaid Products, Inc., Torrance, CA (US)

( * ) Notice: Subject to any disclaimer, the term of this patent is extended or adjusted under 35 U.S.C. 154(b) by 0 days.

(21) Appl. No.: 10/185,778

(22) Filed: Jun. 27, 2002

(65) Prior Publication Data

US 2004/0000806 A1 Jan. 1, 2004

(51) Int. Cl.[7] ..... A47C 1/032

(52) U.S. Cl. ..... 297/284.9; 297/353; 297/411.1; 297/464

(58) Field of Search ..... 297/353, 284.1, 297/284.9, 391, 411.1, 464, 466, 486

(56) References Cited

U.S. PATENT DOCUMENTS

| | | | | | |
|---|---|---|---|---|---|
| 1,527,754 | A | * | 2/1925 | Simon | 601/24 |
| 3,466,091 | A | * | 9/1969 | De Grusso | 297/486 |
| 3,679,257 | A | * | 7/1972 | Jacuzzi et al. | 297/42 |
| 3,773,382 | A | * | 11/1973 | Coursault et al. | 297/284.9 |
| 3,829,159 | A | * | 8/1974 | Leffler | 297/411.31 |
| 4,073,537 | A | * | 2/1978 | Hammersburg | 297/464 |
| 4,527,829 | A | * | 7/1985 | Fanslau et al. | 297/17 |
| 4,640,525 | A | * | 2/1987 | Jensen et al. | 280/642 |
| 4,647,066 | A | * | 3/1987 | Walton | 297/284.1 |
| 4,763,951 | A | * | 8/1988 | Silverman | 297/440.15 |
| 5,447,356 | A | * | 9/1995 | Snijders | 297/284.3 |
| 5,496,092 | A | * | 3/1996 | Williams et al. | 297/250.1 |
| 5,636,900 | A | * | 6/1997 | Wilkie et al. | 297/423.19 |
| 5,718,479 | A | * | 2/1998 | Rautenbach | 297/354.13 |
| 6,203,106 | B1 | * | 3/2001 | Nearing et al. | 297/329 |
| 6,257,664 | B1 | * | 7/2001 | Chew et al. | 297/284.9 |
| 6,343,805 | B1 | * | 2/2002 | Roy | 280/250.1 |
| 6,361,118 | B1 | * | 3/2002 | Melgarejo et al. | 297/488 |
| 6,378,947 | B1 | * | 4/2002 | Barber et al. | 297/452.25 |

FOREIGN PATENT DOCUMENTS

DE 1193115 A2 * 4/2002

* cited by examiner

*Primary Examiner*—Peter M. Cuomo
*Assistant Examiner*—Joseph Edell
(74) *Attorney, Agent, or Firm*—Greenberg Traurig, LLP; Louis J. Bovasso

(57) ABSTRACT

Systems and techniques are disclosed for a planar seating apparatus having a seat support in a first plane, a back support in a second plane and coupled to the seat support, and a plurality of side supports coupled to the back support. The plurality of side supports are adjustable and capable of folding, as is the back support, to provide a compact and easily transportable and storable device.

10 Claims, 18 Drawing Sheets

ADJUSTABLE FOLDING PLANAR SEAT

BACKGROUND OF THE INVENTION

1. Field of the Invention

The present invention relates to a seating arrangement. More specifically, the present invention relates to an adjustable, planar seating arrangement that is capable of folding for convenient handling and transportation.

2. General Background and State of the Art

Seating arrangements for use in wheelchairs, strollers, and other types of mobile chairs, are often rigid and unable to fold, making them difficult to easily transport and store. Some handicapped children benefit from, and many rehabilitation professionals prefer, seating arrangements that are easy to transport and adjust. Some existing seating arrangements offer positioning mechanisms such as brackets and slotted bolt holes, which may be cumbersome and difficult to transport. Other existing seating arrangements provide for planar seat elements to fold in a back-to-back fashion, reducing the bulk for transportation but leaving other positioning elements projecting out away from the seat elements.

Therefore, there is a need in the art for a seating arrangement having planar seating elements, adjustable positioning elements, and an adjustable configuration. This seating arrangement must be easily adjustable and foldable for convenient transportation.

INVENTION SUMMARY

In one aspect of the present invention, a seating apparatus includes a seat support in a first plane, a back support in a second plane and coupled to the seat support, and a plurality of side supports coupled to the back support, the plurality of side supports including a pair of lateral supports and a pair of pelvic supports. The pair of lateral supports are adjustable and capable of folding relative to the back support such that the back support and the pair of lateral supports are substantially positioned in the second plane, and the pair of pelvic supports are adjustable and capable of folding relative to the seat support such that the seat support and the pair of pelvic supports are substantially positioned in the first plane, and wherein the back support is configured to fold relative to the seat support.

In another aspect of the present invention, a seating apparatus includes a seating system including a seat support in a first plane, a back support in a second plane, a pair of lateral supports coupled to the back support, and a pair of pelvic supports coupled to the back support, folding means configured to allow the back support and the pair of pelvic supports to fold relative to the seat support and the pair of lateral supports to fold relative to the back support, and adjustment means configured to allow for the adjustment of the back support, the pair of lateral supports, and the pair of pelvic supports according to the needs of a user.

In yet another aspect of the present invention, a method of providing a planar seating apparatus includes providing a system of planar supports, including a seat support in a first plane, a back support in a second plane and coupled to the seat support, a lateral support apparatus coupled to the back support and having a pair of lateral supports, and a pelvic support apparatus coupled to the back support and having a pair of pelvic supports, and positioning the back support, the lateral supports and the pelvic supports according to the needs of a user, so that the lateral supports are configured to fold relative to the back support, the pelvic supports are configured to fold relative to the seat support, and the back support is configured to fold relative to the seat support.

In still another aspect of the present invention, a method of folding an adjustable planar seating apparatus includes providing a system of planar supports, including a seat support in a first plane, a back support in a second plane, a lateral support apparatus coupled to the back support, and a pelvic support apparatus coupled to the back support, and folding the lateral support apparatus relative to the back support such that the lateral support apparatus lies substantially in the second plane, and folding the back support and the pelvic support apparatus relative to the seat support such that the back support and pelvic support apparatus lay substantially in the first plane.

It is understood that other embodiments of the present invention will become readily apparent to those skilled in the art from the following detailed description, wherein it is shown and described only exemplary embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

Aspects of the present invention are illustrated by way of example, and not by way of limitation, in the accompanying drawings wherein.

DETAILED DESCRIPTION OF THE EMBODIMENTS

The detailed description set forth below in connection with the appended drawings is intended as a description of exemplary embodiments in which the present invention can be practiced. The term "exemplary" used throughout this description means "serving as an example, instance, or illustration," and should not necessarily be construed as preferred or advantageous over other embodiments. The detailed description includes specific details for the purpose of providing a thorough understanding of the present invention. However, it will be apparent to those skilled in the art that the present invention may be practiced without these specific details. In some instances, well known structures and devices are shown in block diagram form in order to avoid obscuring the concepts of the present invention.

In an exemplary embodiment of the present invention, a planar seating apparatus includes a seat support in a first plane, a back support in a second plane and coupled to the seat support, and a plurality of side supports coupled to the back support. The plurality of side supports include a pair of lateral supports and a pair of pelvic supports. The pair of lateral supports are adjustable and capable of folding relative to the back support, so that the back support and the pair of lateral supports are substantially positioned in the second plane. The pair of pelvic supports are adjustable and capable of folding relative to the seat support, so that the seat support and the pair of pelvic supports are substantially positioned in the first plane. The back support is also configured to fold relative to the seat support. A planar seating apparatus according to the present invention may be configured to attach to the frame of a wheelchair or a stroller, so that the planar seating apparatus is removable for storage and transportation. The planar seating apparatus may also be coupled to a frame such that it is not removable but still folds for storage and transportation of the device onto which it is coupled.

Although various aspects of the present invention may be described in the context of wheelchairs, strollers, and other types of mobile devices, those skilled in the art will appreciate that the planar seating apparatus and method are likewise suitable for use in various other environments. Accordingly, any reference to a wheelchair, stroller, or other mobile device is intended only to illustrate the inventive aspects of the present invention, with the understanding that such inventive aspects have a wide range of applications.

Figure 1:
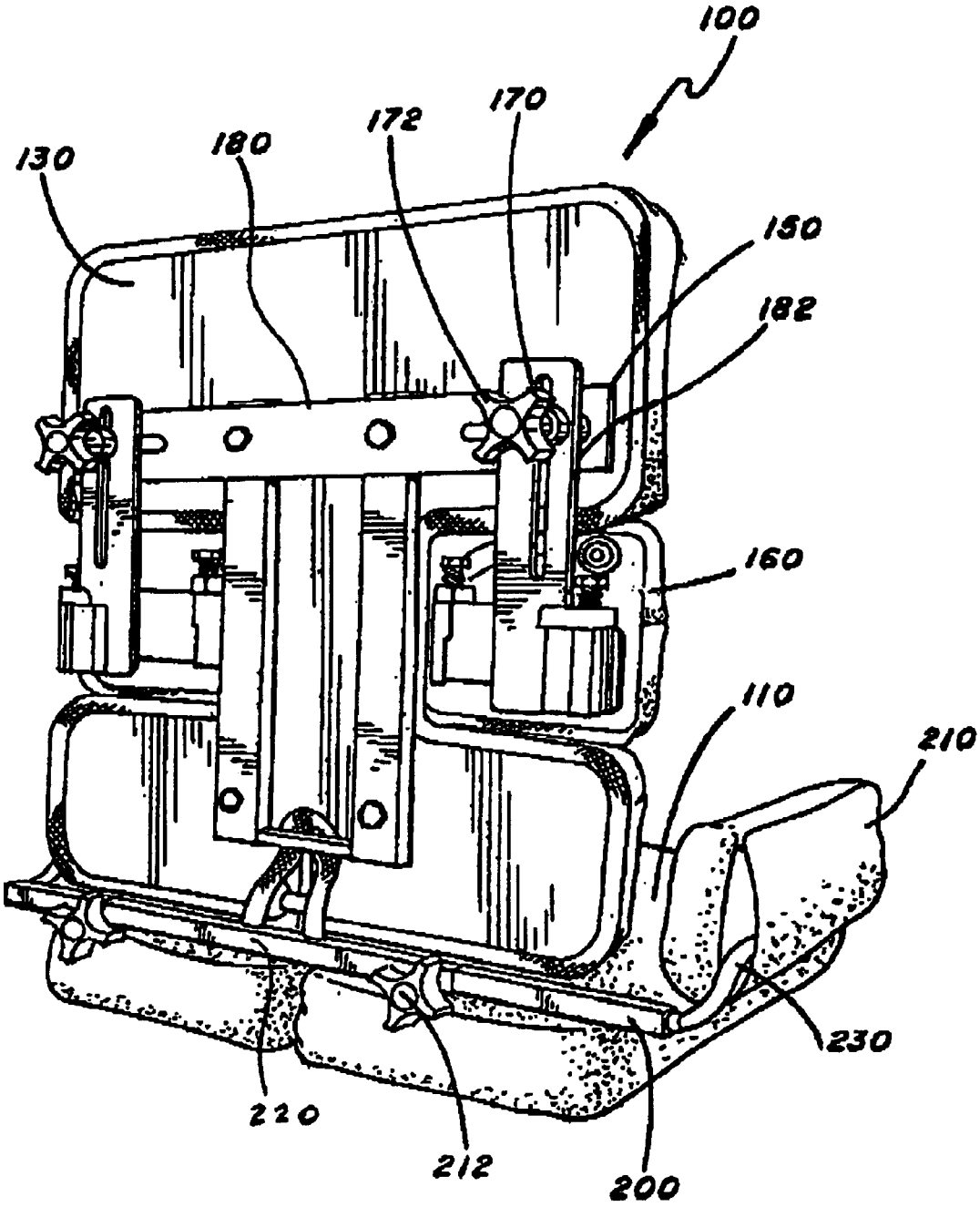
FIG. 1 is a perspective view of a seating arrangement according to the present invention.

FIG. 1 is a perspective view of a seating arrangement 100 according to the present invention. FIG. 1 shows a seating arrangement 100 in an upright position and having a seat support 110 positioned in a first plane 120 and a back support 130 positioned in a second plane 140. The seating arrangement 100 also includes a lateral support apparatus 150 having a pair of lateral supports 160, a lateral support release mechanism 170, a horizontal bracket 180, a vertical bracket 182, and a pair of lateral support arms 190. The lateral supports 160 are shown in FIG. 1 as positioned in substantially the same plane, the second plane 140, as the back support 130. The lateral supports 160 are movable from this planar position to extend in a substantially perpendicular position relative to the back support 130. The seating arrangement 100 also includes a pelvic support apparatus 200 having a pair of pelvic supports 210, a pelvic support release mechanism 220, and a pair of pelvic support arms 230. The pelvic supports 210 are shown positioned in a substantially perpendicular manner relative to the seat support 110. The pelvic supports 210 are moveable to a position in the first plane 120 relative to the seat support 110 such that the pelvic supports 210 are in plane substantially parallel to the first plane 120.

The seating arrangement 100 may also be described as having a seating system in which a seat support is positioned in a first plane, a back support is positioned in a second plane, a pair of lateral supports are coupled to the back support. The seating system may also include pair of pelvic supports coupled to the back support. The pair of lateral supports and the pair of pelvic supports comprise a plurality of side supports, having the components described herein in this specification.

Movable components for use in the present invention may be made of any material allowing the components to move relative to each other for folding, adjusting, or sliding. Materials may include aluminum, stainless steel, or any other similar material commonly known in the art. The back support and seat support may be made of plywood covered with at least one layer of foam, and then covered with vinyl or other water-proof and weather-proof fabric. The at least one layer of foam may include multiple layers of foam, and may have layers of progressive size and firmness to provide comfort to a user of the seating arrangement 100.

Figure 2:
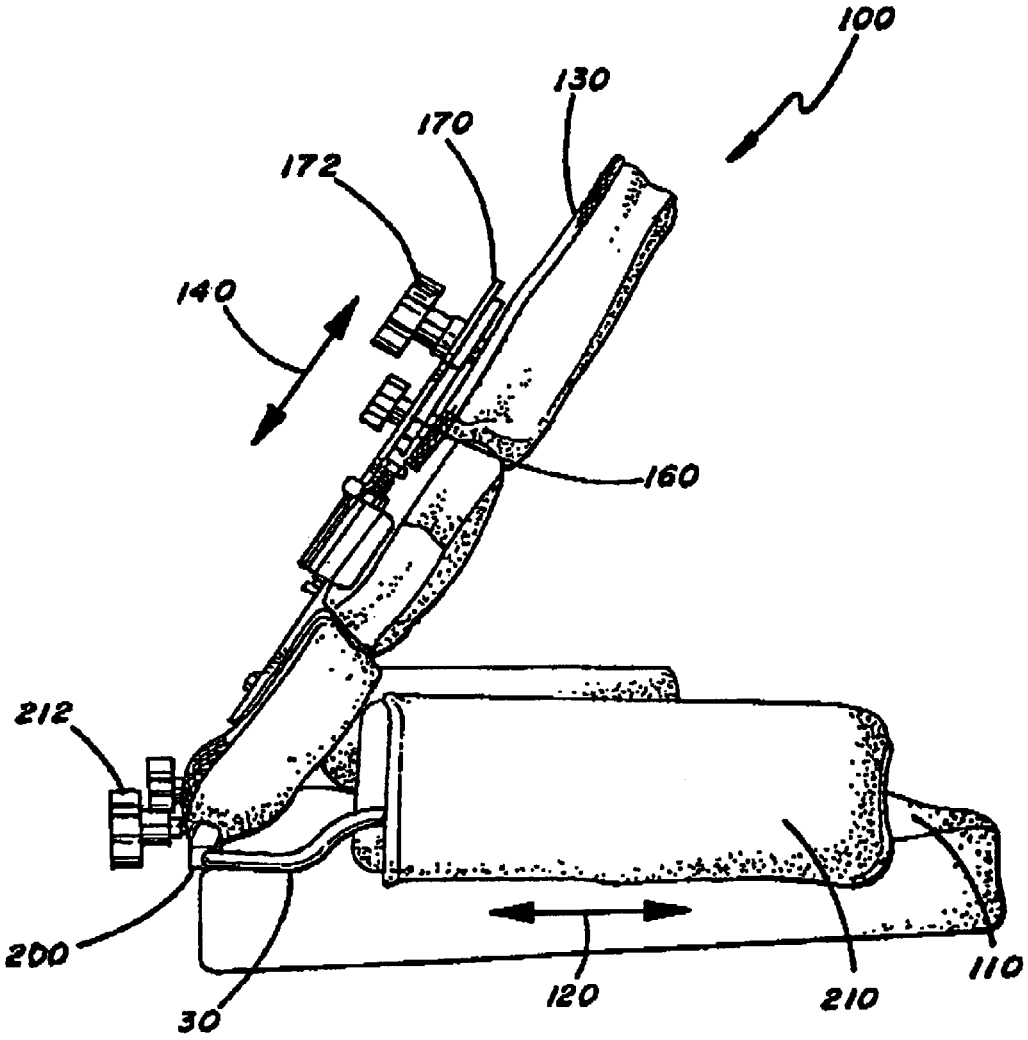
FIG. 2 is a side view of a seating arrangement having a back support being moved toward a seat support.
Figure 3:
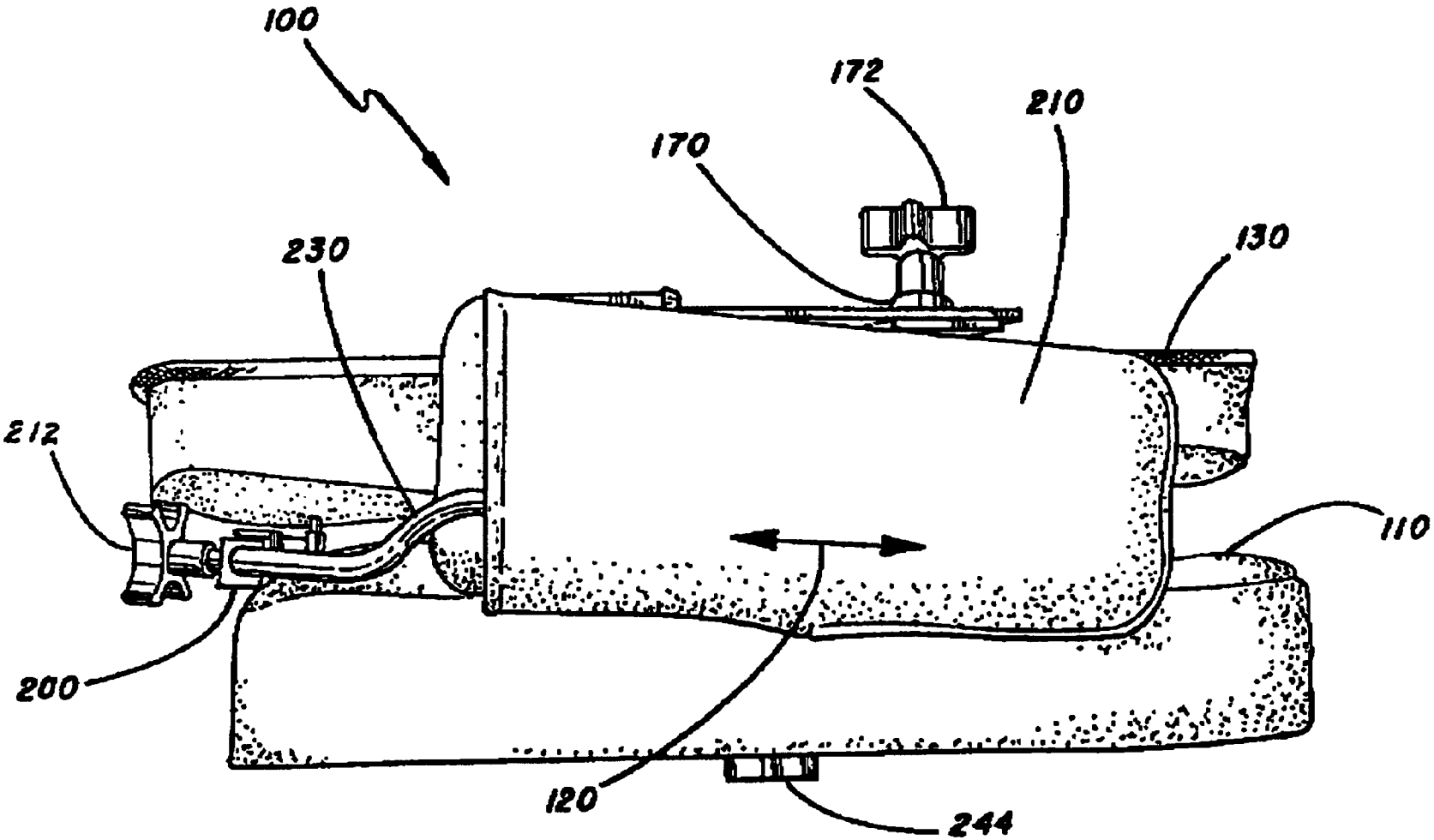
FIG. 3 is a side view of a seating arrangement in which the back support is folded into the same plane as the seat support.

FIG. 2 is a side view of the seating arrangement 100 of the present invention. The seating arrangement 100 in FIG. 2 is shown having the back support 130 being pushed downward relative to the seat support 110 to show the folding capability of the seating arrangement 100. FIG. 3 is an additional side view of the seating arrangement 100 of the present invention showing the back support 130 folded in a manner such that it is in a substantially parallel plane relative to the first plane 120. The folding capability demonstrated in FIG. 3 shows that the seating arrangement 100 can be folded into a compact, planar seating apparatus for easy storage and transportation.

Figure 4:
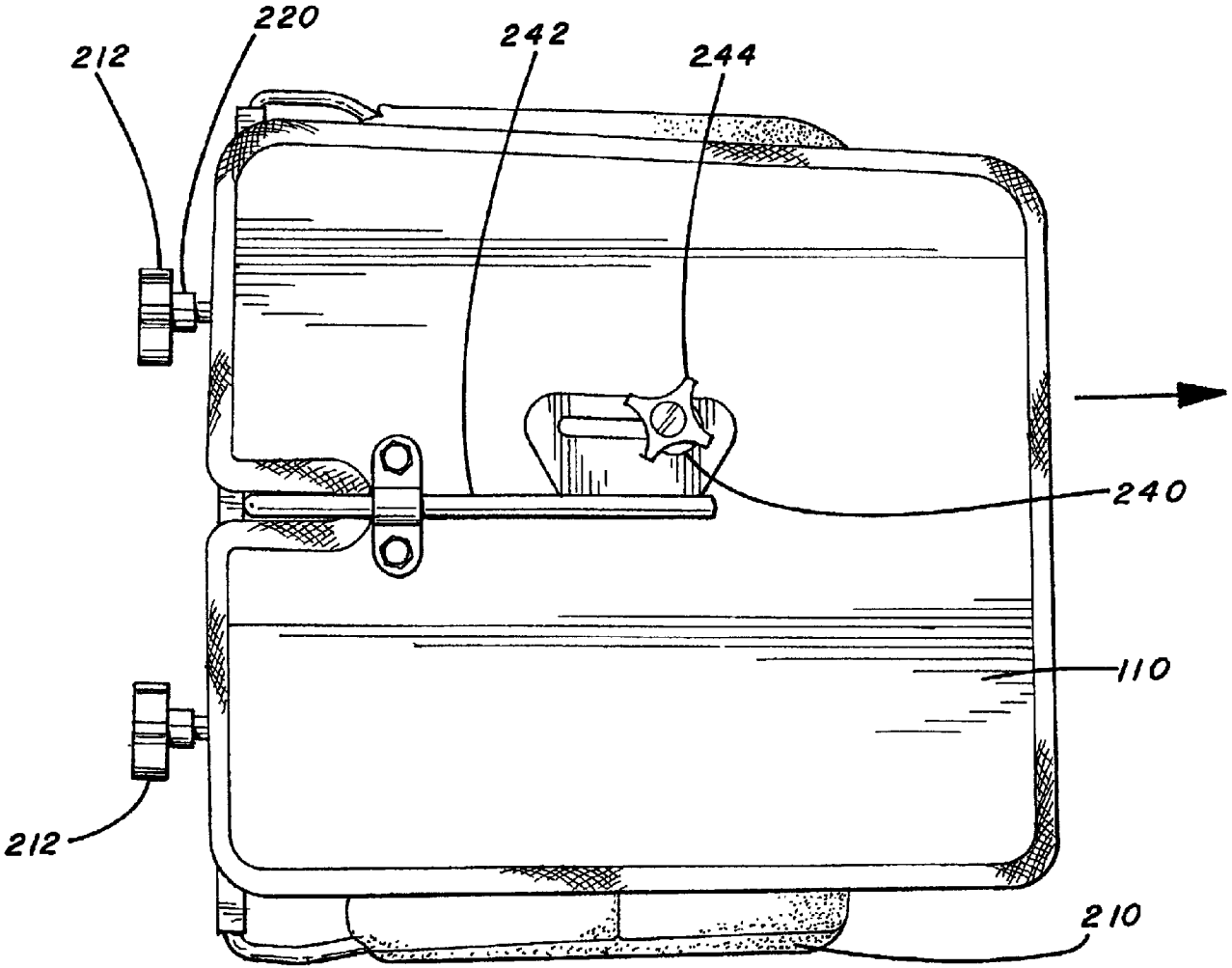
FIG. 4 is a bottom view of a seating arrangement according to the present invention.

FIG. 4 shows a bottom view of the seating arrangement 100. The seating arrangement 100 includes a seat support release mechanism 240, which allows the seat support 110 to be adjusted relative to the back support 130. By activating the seat support release mechanism 240, a depth of the seat support 110 relative to the back support 130 can be adjusted according to the needs of a user of the seating arrangement 100. The depth may be adjusted for a variety of purposes, including for children of different sizes utilizing the seating arrangement 100 or for a variety of different seating positions for users of the seating arrangement 100. The seat support release mechanism 240 includes a bar 242 and a knob 244 positioned in a track 245. The seat support release mechanism 240 is activated by turning the knob 244 and sliding the knob 244 in the track 245. This slides the seat support 110 to adjust the depth as desired.

Figure 5:
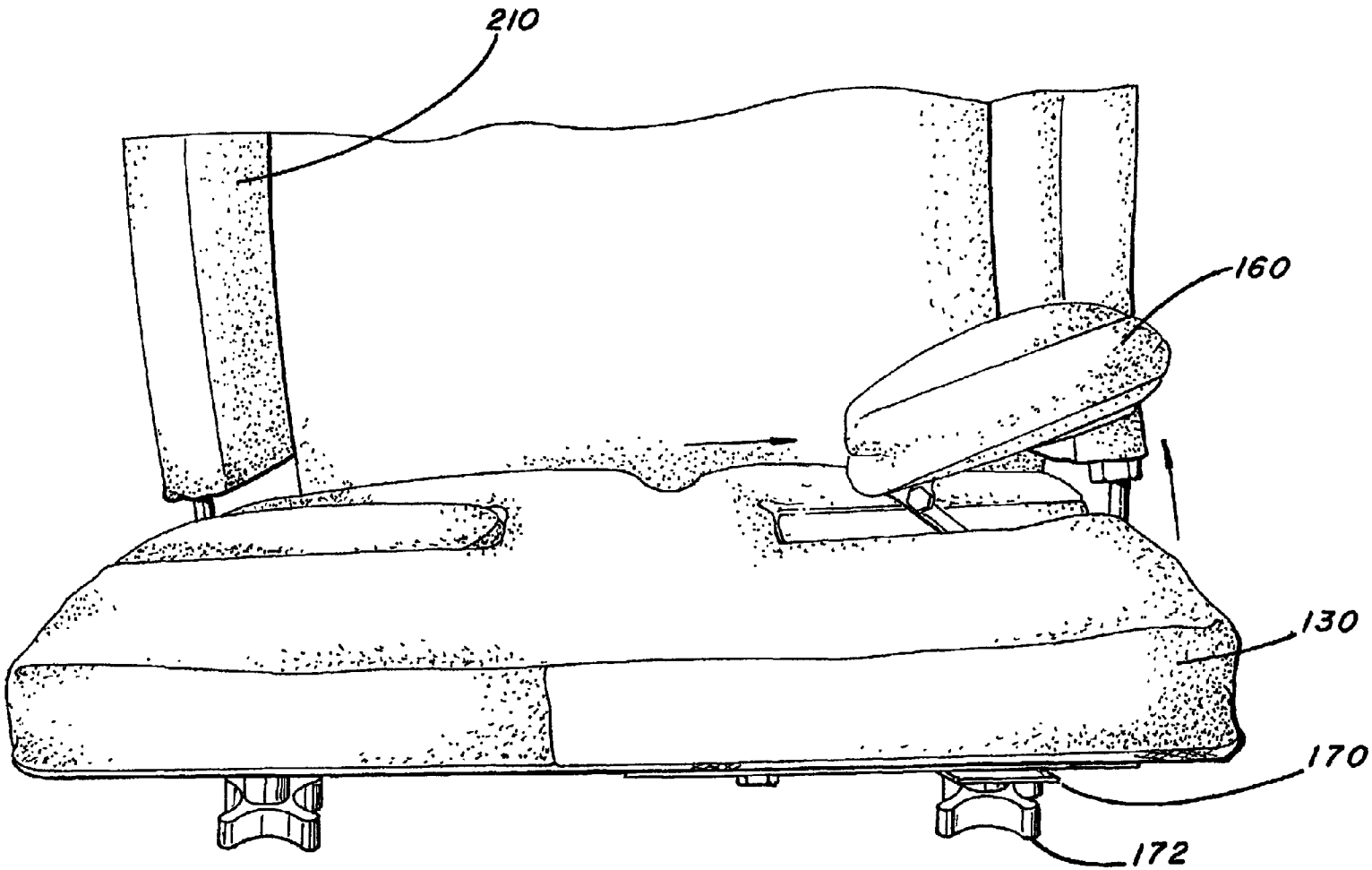
FIG. 5 is a close-up top view of a seating arrangement showing movement of a lateral support from a folded position.

FIG. 5 is a close-up top view of the seating arrangement 100. FIG. 5 shows one of the lateral supports 160 being moved from a substantially planar position relative to the back support 130 to an extended position as desired by the user. The lateral support 160 may be moved from a parallel position relative to the back support 130 in the second plane 140 by grasping the lateral support 160 and physically moving it from its planar position to a desired position.

Figure 6:
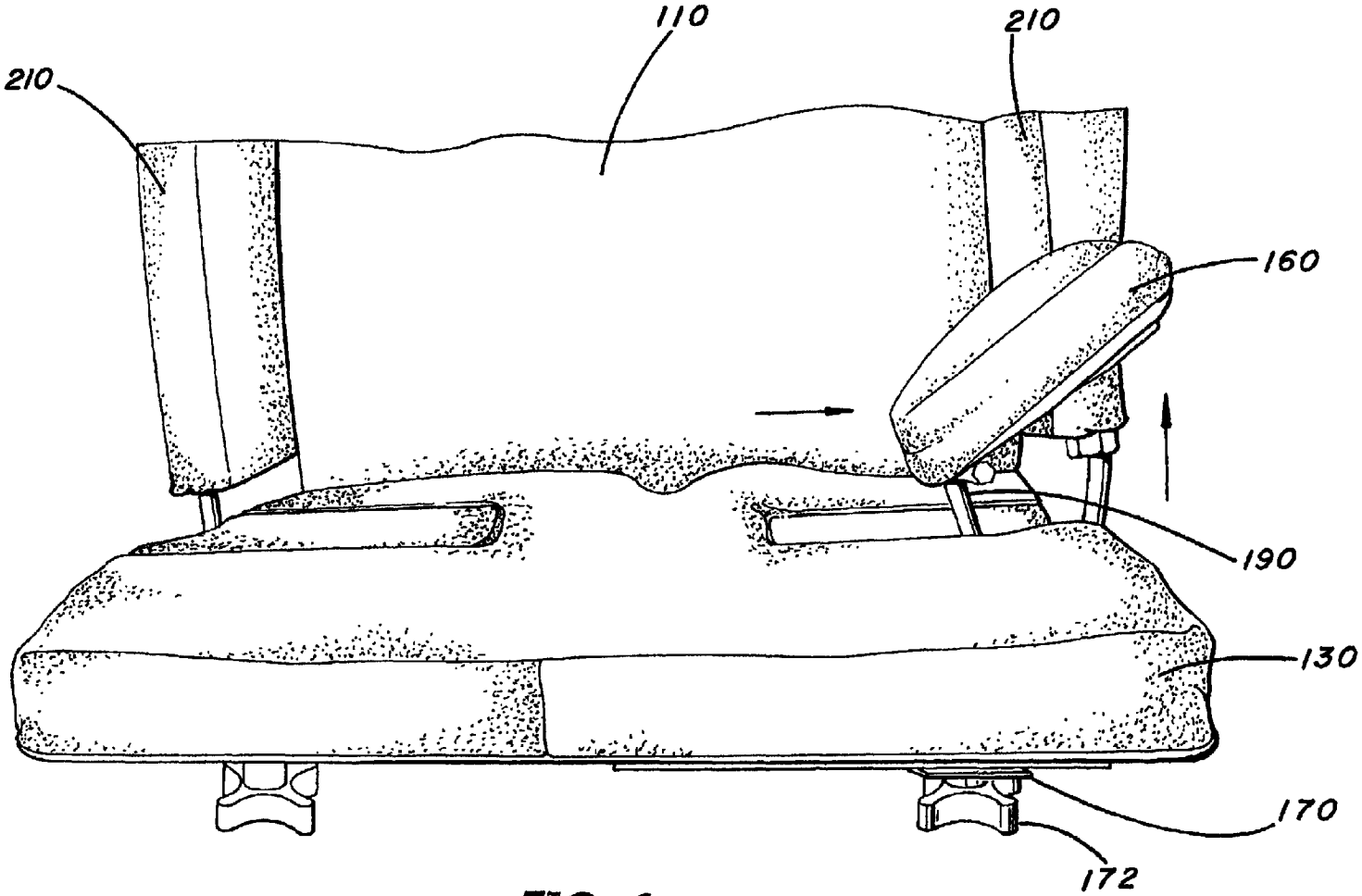
FIG. 6 is a close-up top view of a seating arrangement showing further movement from that of FIG. 5 of a lateral support from a folded position.
Figure 7:
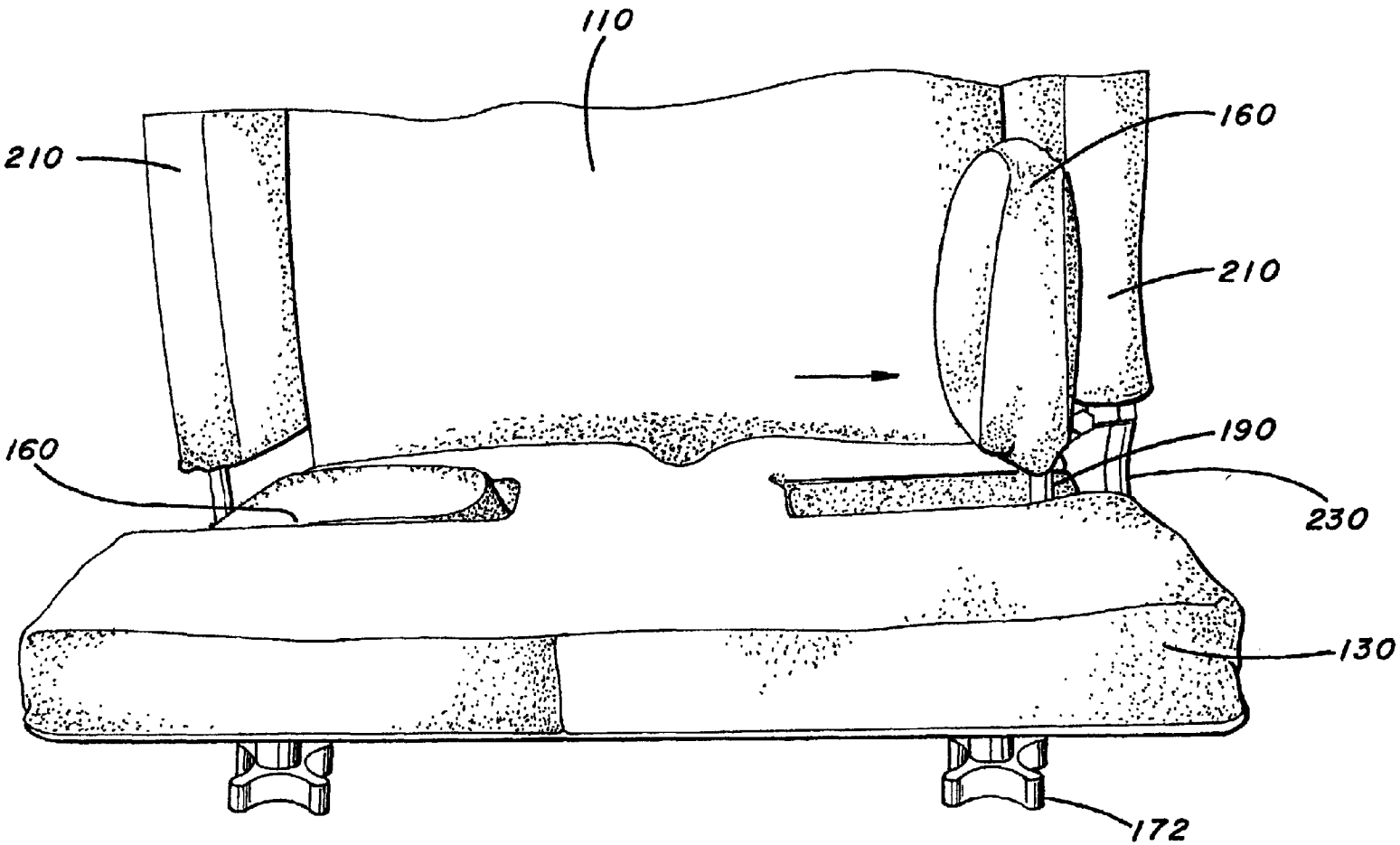
FIG. 7 close-up top view of a seating arrangement showing one lateral support in a fully folded position and another lateral support in a fully extended position.

FIG. 6 is an additional close-up top view of the seating arrangement 100. FIG. 6 shows one of the lateral supports 160 in a substantially planar position relative to the back support 130, and the other lateral support 160 being extended from its substantially planar position relative to the back support 130. FIG. 7 is yet another close-up top view of the seating arrangement 100, showing one of the lateral supports 160 in a substantially planar position relative to the back support 130, and the other lateral support 160 in a fully extended position substantially perpendicular relative to the second plane 140 and the back support 130.

Figure 8:
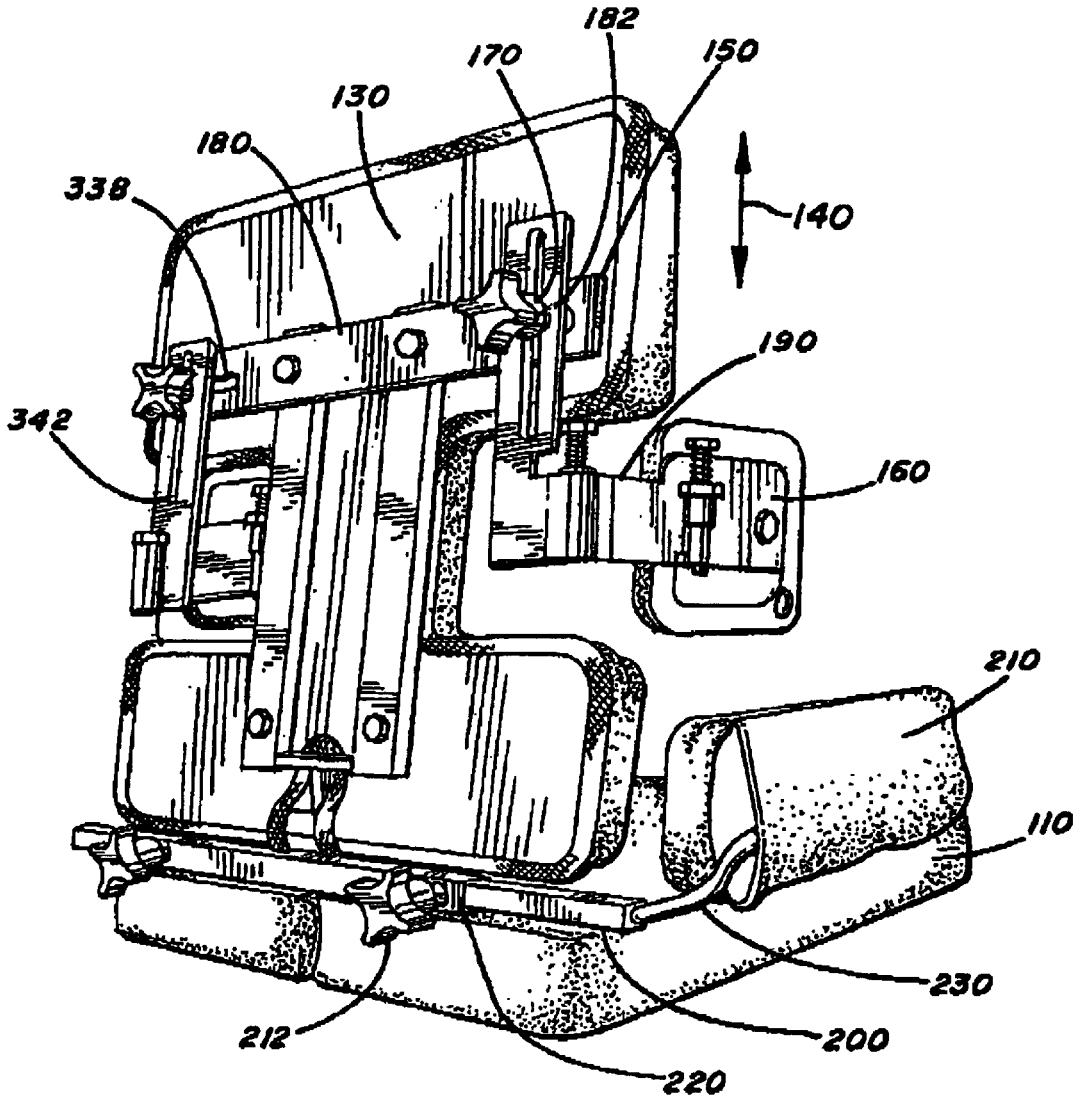
FIG. 8 is perspective view a seating arrangement showing one lateral support in a fully folded position and another lateral support in a fully extended position.

FIG. 8 is a perspective view of the seating arrangement 100. FIG. 8 shows one of the lateral supports 160 being adjusted by turning its respective lateral knob 172 and thereby activating the lateral support release mechanism 170. By turning the lateral knob 170, a lateral support 160 can be adjusted in either a vertical or a horizontal manner. Accordingly, the height of a lateral support 160 can be adjusted to accommodate different users of the seating arrangement 100. Also, the width between each of the lateral supports 160 can be adjusted by turning the lateral knob 172 and activating the lateral support release mechanism 170. Therefore, the positioning of the lateral support can be adjusted to accommodate different needs of a user. The lateral support arm 190 is coupled to the vertical bracket 182 and the lateral knob 172 couples the vertical bracket 182 to the horizontal bracket 180. Turning the lateral support knob 172 loosens the vertical bracket 182 and the horizontal bracket 180, allowing the vertical bracket 182 to be moved either horizontally along a track 338 in the horizontal bracket 180, or vertically in a track 342 in the vertical bracket 182, to position the lateral support 160. FIG. 8 also shows a pelvic support 210 coupled to a pelvic support arm 230. The pelvic support 210 shown in FIG. 8 is in a substantially perpendicular position relative to the seat support 110.

Figure 9:
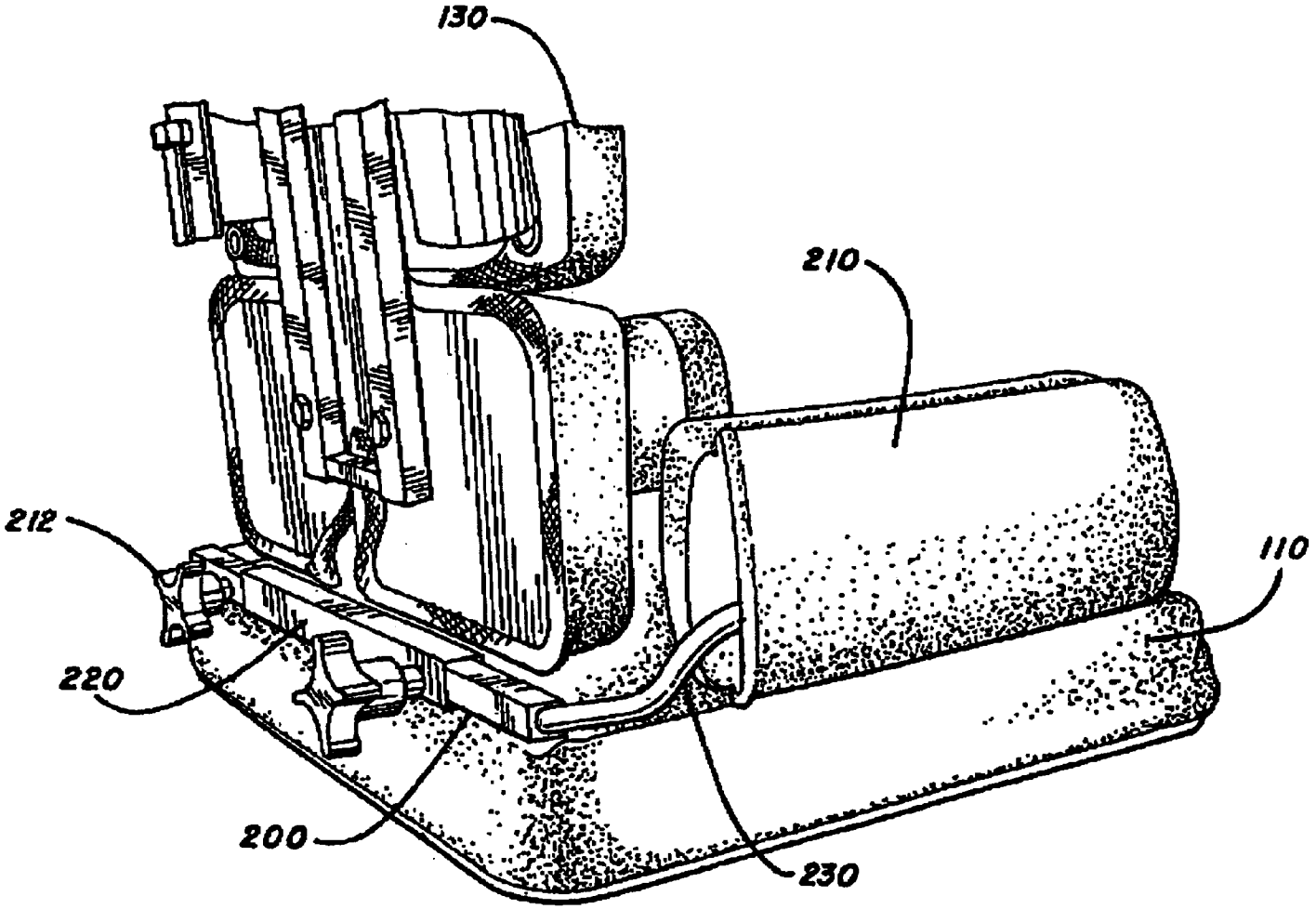
FIG. 9 is a close-up perspective view of a seating arrangement showing a pelvic support in an extended position relative to the seat support.

FIG. 9 is a close-up perspective view of the seating arrangement 100. FIG. 9 shows a pelvic support 210 about to be adjusted by activating the pelvic support release mechanism 220. This is accomplished by turning the pelvic support knob 212 to loosen the pelvic support 210 and sliding the pelvic support arm 230 horizontally until the proper positioning relative to the other pelvic support 210 is achieved, and then tightening the pelvic support knob 212. In this manner, the distance between the two pelvic supports 210, can be adjusted according to the needs of the user.

The lateral support release mechanism 170, the pelvic support release mechanism 220, the seat support release mechanism 240, and the hip abductor release mechanism 260 may all include knobs, which, when turned to loosen components, activate the respective release mechanisms and allow the attached components to move. Turning the knobs to tighten the components stops the movement of the components, or deactivates them. It should therefore be noted that this specification contemplates that in one embodiment, the process of turning a knob to tighten and loosen connections between components is an activation of a release mechanism.

It is the movement of the components, such as the lateral support apparatus 150 and its lateral supports 160, and the pelvic support apparatus 200 and its pelvic supports 210, that allow the seating arrangement 100 to fold. The invention contemplates that many different methods of allowing the components to move may be utilized, and that activation of a release mechanism or mechanisms is but one means for facilitating the folding of the seating arrangement 100. One method includes the use of removable pins or bolts to secure the plurality of supports in desired positions, such that upon removal of the pins or bolts, the plurality of supports are capable of folding or collapsing. In another method, the plurality of supports are completely removable from the seating arrangement 100 to allow the back support 130 and the seat support 110 to fold.

It is the movement of the components, such as the lateral support apparatus 150 and its lateral supports 160, the pelvic support apparatus 200 and its pelvic supports 210, the seat support 110, the hip abductor apparatus 250, and the foot support 270, that allow the components of the seating arrangement 100 to be adjustable to accommodate the needs of different users. The invention contemplates that many different methods of allowing the components to move may be utilized, and that activation of a release mechanism or mechanisms is but one means for facilitating the adjustment of the seating arrangement 100. One method includes the use of removable pins or bolts to secure the plurality of supports in desired positions, such that upon removal of the pins or bolts, the plurality of supports are capable of moving to desired positions, which are then securable by replacing the pins or bolts.

Figure 10:
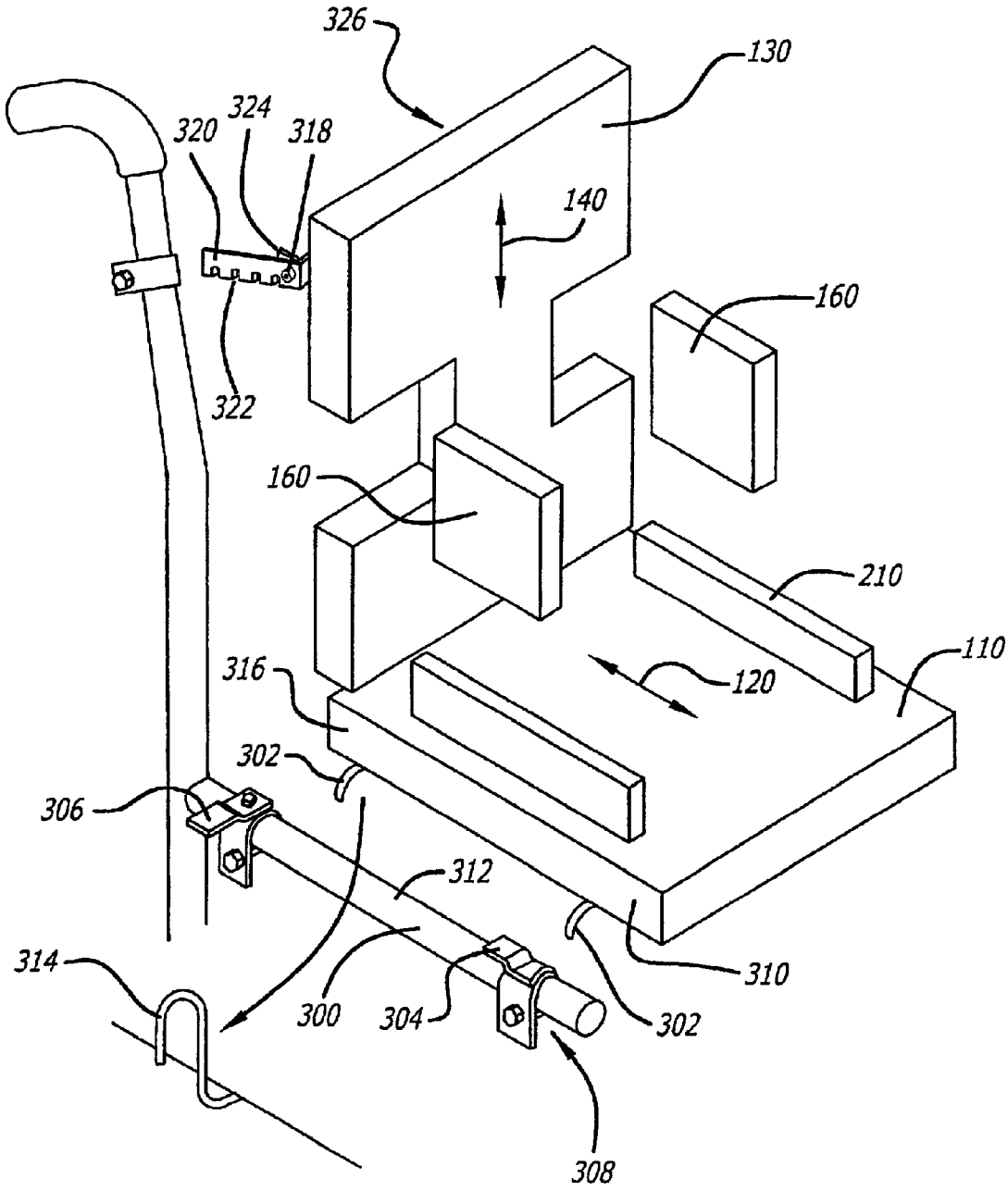
FIG. 10 is an additional perspective view of a seating arrangement.

FIG. 10 is an additional perspective view of a seating arrangement 100, showing the seating arrangement being mounted onto a frame 300 of a wheelchair or other mobile device. Seat hooks 302 may be employed to position the seat support 110 on the frame 300. The seat hooks 302 may be mounted underneath the seat support 110. The frame 300 includes latches 304 and 306 which receive the seat hooks 302 to allow the seat support 110 of the seating arrangement 100 to rest on the frame 300 in a secure manner. Latch 304, positioned at a front 308 of the frame 300, is positioned such that the seat hook 302 on a front 310 of the seat support 110 slides between the latch 304 and the frame 300 to secure the seat hook 302. The seat hook 302 on a rear 316 of the seat support 110 then is positioned on a rear 312 of the frame 300. Latch 306, positioned on the rear 312 of the frame 300, then is turned from its perpendicular position shown in FIG. 10 to a parallel position relative the frame 300 to secure the seat hook 302 to the frame 300.

A drop hook indicated by reference numeral 314 shows another embodiment of seat hook 302 which allows the seating arrangement 100 to be positioned lower than when seat hooks 302 are used. The drop hook 314 is positioned at the rear 316 of the seat support 110 so that the back of the seating arrangement 100 is positioned lower than the front 310 of the seat support 110. The seating arrangement 100 may also be tilted backward and forward relative to the frame 300 when the drop hook 314 is used. The drop hook 314 is therefore coupled to the rear 316 of the seat support 110. In this embodiment, a seat hook 302 is also included and coupled to the front 310 of the seat support 110. Latches 304 and 306 secure the drop hook 314 and seat hook 302 to the frame 300 as discussed above.

Figure 11:
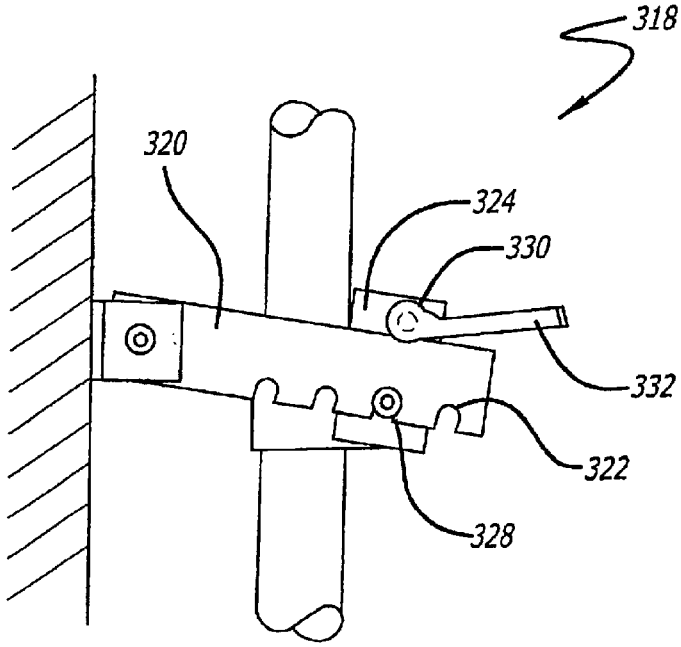
FIG. 11 is a close-up view of a coupling mechanism for coupling a seating arrangement to a frame of a wheelchair or stroller.

FIG. 11 is a close-up view of one embodiment of a coupling mechanism 318 for coupling the seating arrangement 100 to the frame 300 of a wheelchair or stroller. In this embodiment, the coupling mechanism 318 includes a notched bar 320 having a plurality of notches 322. The coupling mechanism 318 also includes an extension member 324, extending from a rear 326 of the back support 130 of the seating arrangement 100. The extension member 324 includes a nut 328 over which a notch 322 in the plurality of notches 322 can be positioned. The extension member 324 also includes a cam lock 330 which allows the notched bar 320 to be positioned over the nut 328 so that it can engage a notch 322 in the plurality of notches 322. The cam lock 330 is rotatable from a loose position, not shown in FIG. 11, to the locked position shown in FIG. 11, to prevent the notched bar 320 from disengaging from the nut 328. The cam lock 330 includes a lip 332 allowing the cam lock 330 to be moved from one position to another.

Figure 12:
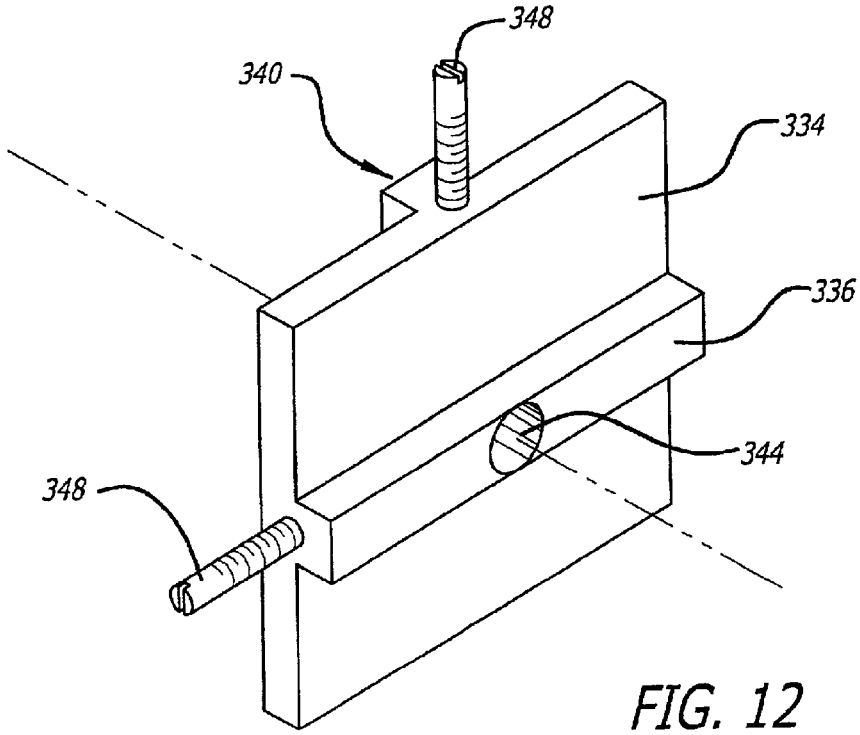
FIG. 12 is a close-up perspective view of a locking component for use with the present invention.
Figure 14:
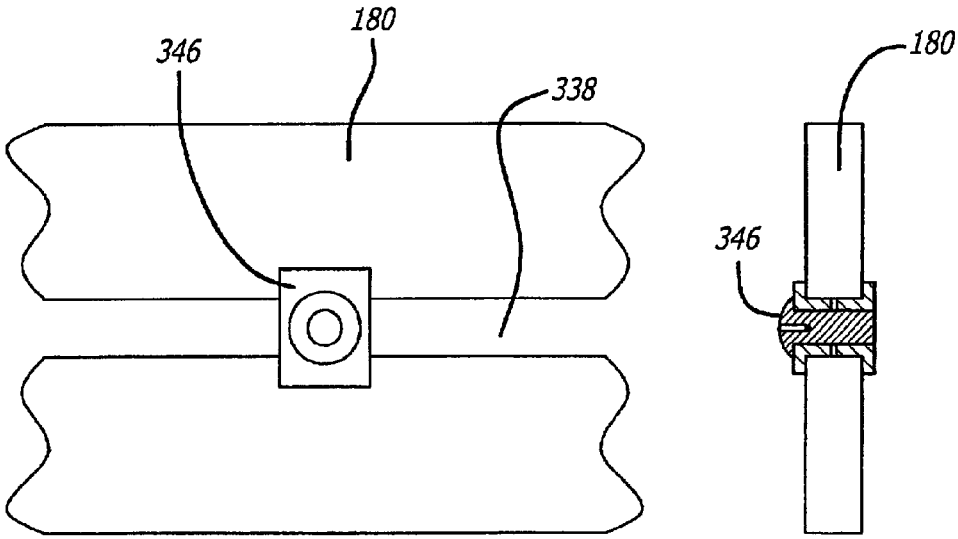
FIG. 14 is a close-up view of another locking component for use with the present invention.

FIG. 12 is a close-up perspective view of a slide lock 334 for use in the lateral support apparatus 150. The slide lock 334 is positioned between the horizontal bracket 180 and the vertical bracket 182. The slide lock 334 includes a horizontal insert 336 that slides along the track 338 of the horizontal bracket 180 and a vertical insert 340 that slides along the track 342 of the vertical bracket 182. The slide lock 334 also includes a cavity 344 in which the lateral knob 172 is positioned. The slide lock 334 maintains the vertical bracket 182 at a 90° angle relative to the horizontal bracket 180 at all times. FIG. 14 is a close-up view of one embodiment of a locking stop 346 for use with the slide lock 334 and the lateral support apparatus 150. The locking stop 346 is positionable in the tracks 338 and 342 of both the horizontal bracket 180 and the vertical bracket 182 to prevent movement in the lateral support apparatus 150 or for a pre-set adjustment of the horizontal and vertical brackets 180 and 182. These locking stops 346 are intended to be removable and insertable by a user of the seating arrangement 100 to add security to the positioning of the lateral supports 160 and to preserve desired settings for lateral supports 160. In another embodiment a pair of screws 348 may also be used to lock the horizontal and vertical brackets 180 and 182 in place. The locking stop 346 and slide lock 334 may each be made of steel or nylon.

Figure 13:
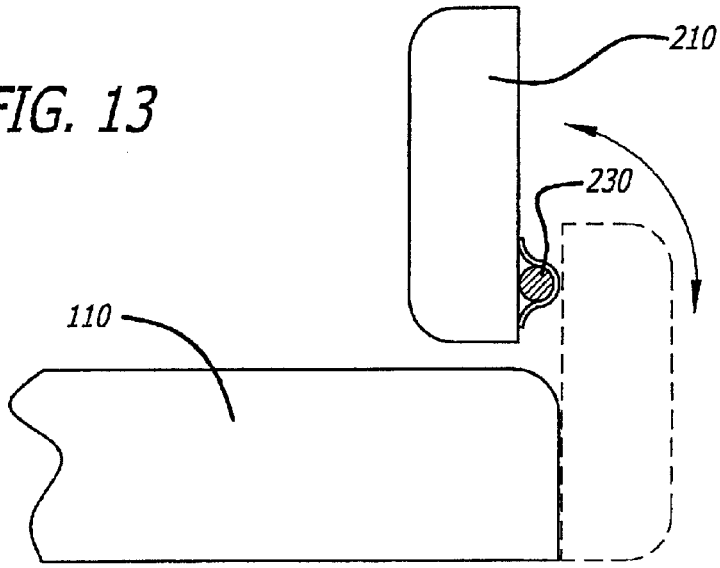
FIG. 13 is a close-up side view of a pelvic support in an extended position relative to a seat support, with a folded position shown in broken lines.

FIG. 13 is a close-up side view of a pelvic support 210 in an extended position relative to a seat support 110, with a folded position shown in broken lines. The pelvic supports 210 are positionable by adjusting the pelvic support apparatus 200 as discussed above. For foldability of the seating arrangement 100, users may desire a variety of options for allowing the back support 130 to collapse and fold to a substantially parallel position relative to the seat support 110. Because having the pelvic supports 210 in a generally extended position as shown in FIG. 13 may prevent the back support 130 from folding to a substantially parallel position relative to the seat support 110, a number of different embodiments are contemplated to allow for adjusting, removing, or positioning the pelvic supports 210. In one embodiment, discussed above under FIG. 9, the pelvic supports 210 are extendable in a horizontal direction relative to each other, such that they can be moved outward from each other to allow the back support 130 to fold into a substantially parallel position as the seat support 110. To achieve such a position, the pelvic support knobs 212 of the pelvic support release mechanism 220 are turned to allow horizontal movement of the pelvic support arms 230 along the pelvic support apparatus. When the desired positions are achieved, the pelvic support knobs 212 are tightened to secure the pelvic support 210 in their folded position. In another embodiment, shown in FIG. 13, the pelvic supports 210 can be adjusted to fold for positioning next to the seat support 110, so that they no longer extend perpendicular to the seat support 110. FIG. 13 shows, in broken lines, the positioning of a pelvic support 210 when in a folded position. To achieve such a folded position, the pelvic support knob 212 of the pelvic support release mechanism 220 is turned to loosen the pelvic support arm 230 to allow rotational movement of the pelvic support 210. When folded, the pelvic support knob 212 is returned to its original position to secure the pelvic support 210 in its folded position. In another embodiment, the pelvic supports 210 are completely removable from the pelvic support apparatus 200 and the seating arrangement 100. This is accomplished by turning the pelvic support knob 212 of the pelvic support release mechanism 220 to allow the pelvic support 210 to be released from a secure position. The pelvic support 210 is then removed from the track in which it rests.

Figure 15:
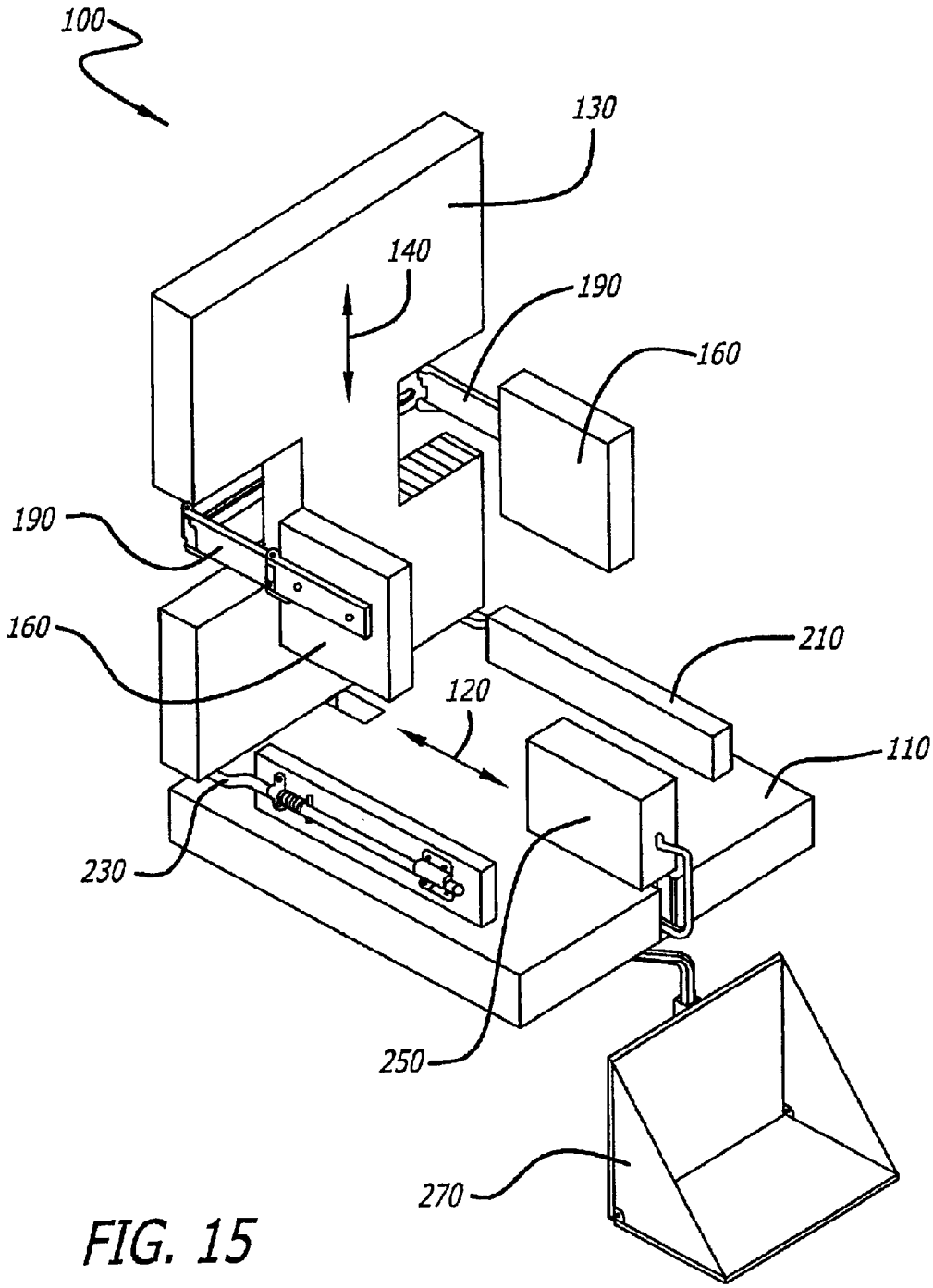
FIG. 15 is an additional perspective view of a seating arrangement according to the present invention showing lateral supports, pelvic supports, a hip abductor, and a foot rest.

FIG. 15 is an additional perspective view of a seating arrangement according to the present invention. FIG. 15 shows the seating arrangement 100 having the seat support 110 positioned in a first plane 120, the back support 130 positioned in a second plane 140, the pair of lateral supports 160, the pair of pelvic supports 210, a hip abductor apparatus 250, and a foot support 270. The hip abductor apparatus 250 includes a hip abductor release mechanism 260. The hip abductor apparatus 250 may be included in the seating arrangement 100 to provide additional support for a person seated in the seating arrangement 100. The foot support 270 includes a foot support release mechanism 280. The foot support 270 may be included in the seating arrangement 100 to provide a stable foot rest for a user of the seating arrangement 100 to prevent the user's legs and feet from dangling unsupported over the edge of the seat support 110, and to substitute for unsuitable wheelchair footrests.

Figure 16:
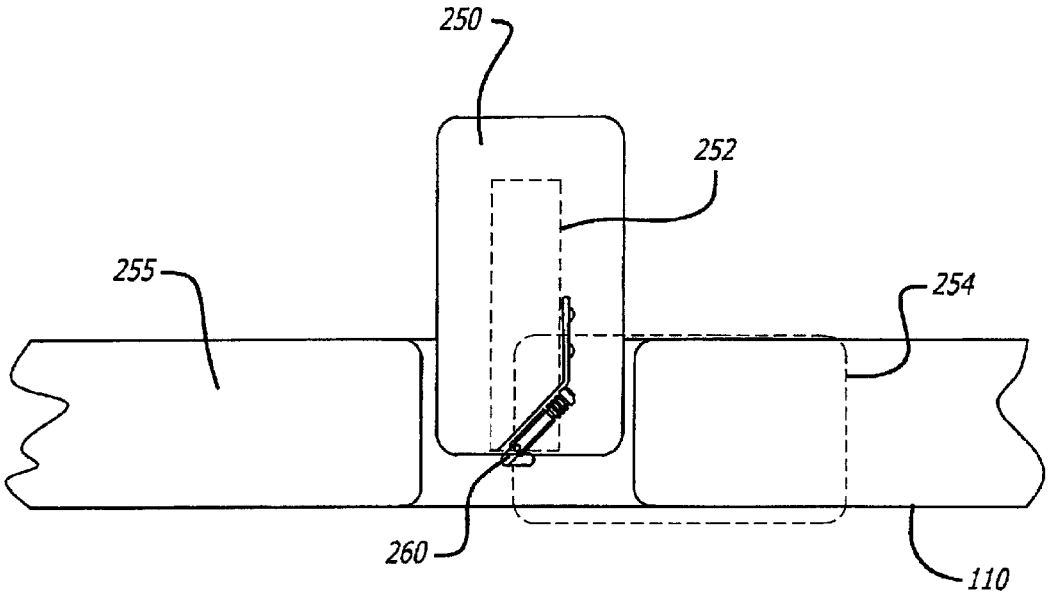
FIG. 16 is a front view of a seat support and a hip abductor according to the present invention, with broken lines indicating rotated movement of the hip abductor.

FIG. 16 is a front plane view of a seat support 110 and a hip abductor apparatus 250 according to the present invention. The hip abductor apparatus 250 and the hip abductor release mechanism 260 are shown in FIG. 16. The hip abductor apparatus 250 is shown in a perpendicular position relative to the seat support 110. Broken lines show a possible position of the hip abductor apparatus 250 when moved. The broken lines identified by reference numeral 254 show the hip abductor apparatus 250 rotated 90° and positioned along a front edge 255 of the seat support 110 to allow the back support 130 to fold down into substantially the same planar position as the seat support 110. Accordingly, the hip abductor release mechanism 260 allows the hip abductor apparatus 250 to be removed from a perpendicular position relative to the seat support 110 to allow the seating arrangement 100 to fold into a compact position. The broken lines identified by reference numeral 252 show a central core portion in one embodiment of the hip abductor apparatus. The central core portion 252 may be included inside the hip abductor apparatus 250 to provide additional support for a person seated in the seating arrangement 100. The central core portion 252 may be made of foam, wood, or any other sturdy material for use in supporting the inner thighs and hips of a person seated in the seating arrangement 100.

Figure 17:
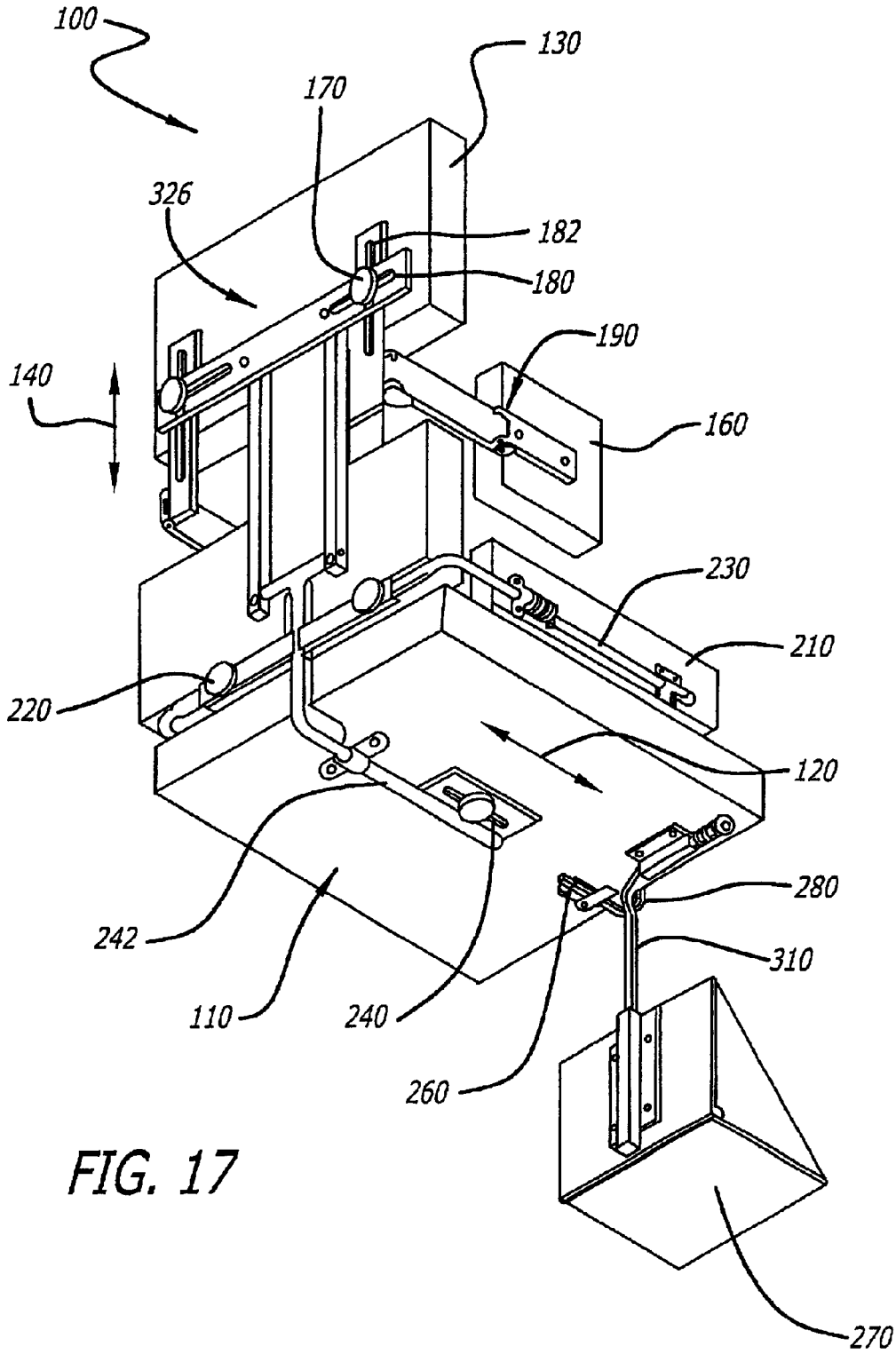
FIG. 17 is a rear perspective view of a seating arrangement according to the present invention.

FIG. 17 is a rear perspective view of a seating arrangement 100 according to the present invention. FIG. 17 shows the various release mechanisms for the lateral support apparatus 150, the pelvic support apparatus 200, the seat support 110, and the foot support 270. FIG. 17 also shows the hip abductor release mechanism 260 positioned underneath the seat support 110.

Figure 18:
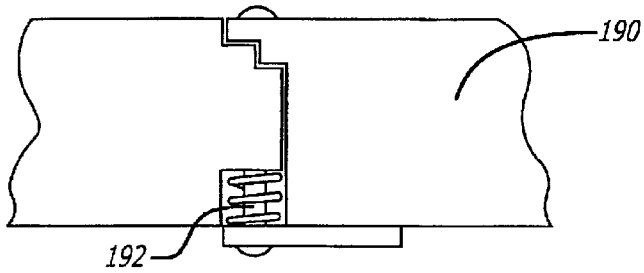
FIG. 18 is a close-up view of a joint mechanism for use with a lateral support of the seating arrangement.

FIG. 18 is a close-up view of a portion of a lateral support arm 190 coupled to a lateral support 160. FIG. 18 shows a joint mechanism portion 192 of the lateral support arm 190, which allows the lateral support 160 to be folded such that it can be positioned in substantially the same second plane 140 as the back support 130.

Figure 19:
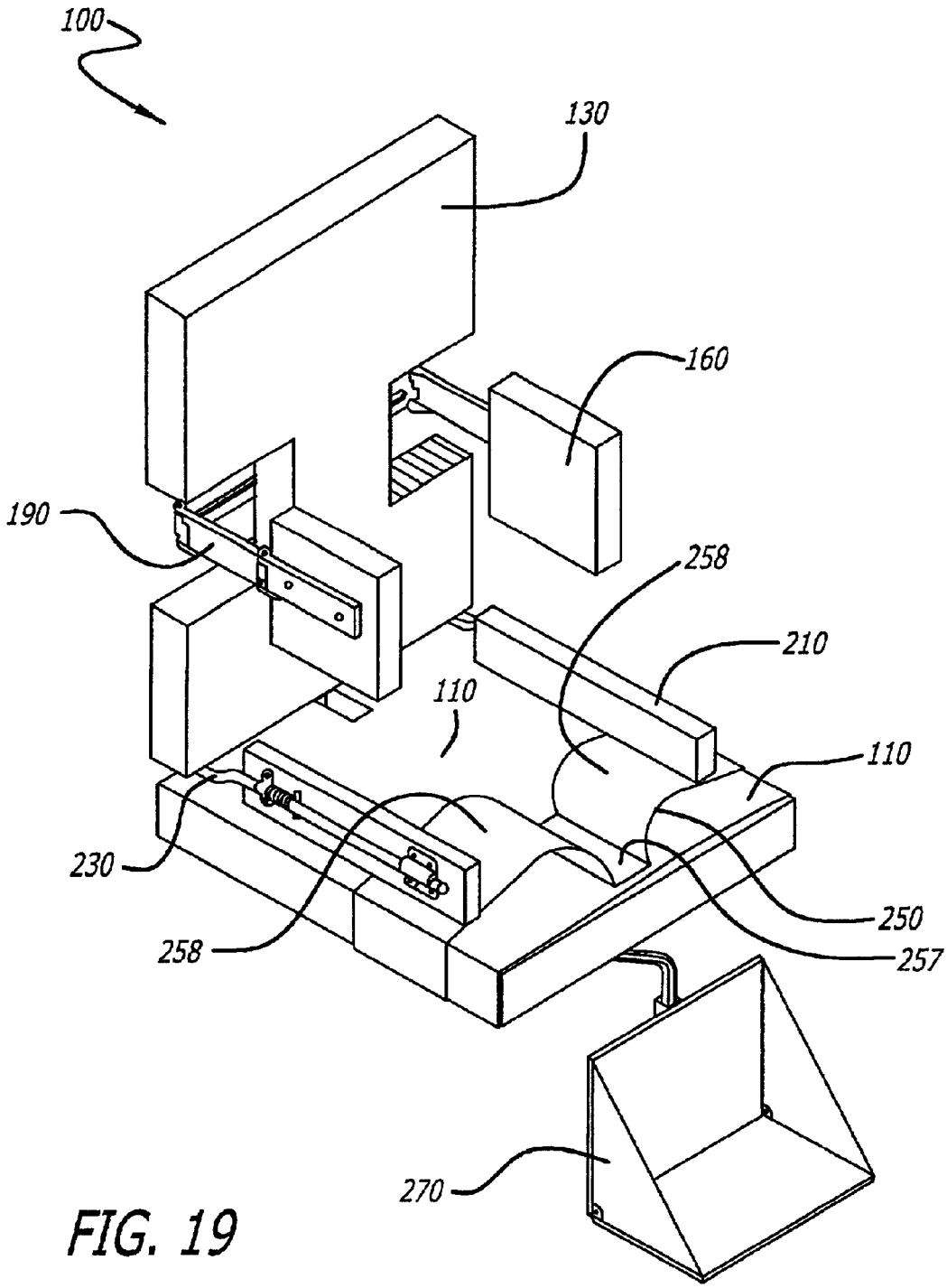
FIG. 19 is a perspective view of a seating arrangement of the present invention showing an alternate embodiment of the hip abductor.

FIG. 19 is an additional perspective view of a seating arrangement 100. FIG. 19 shows an alternate embodiment of the hip abductor apparatus 250. In this embodiment, a user seated in the seating arrangement 100 positions his or her legs between the center portion 257 of the hip abductor apparatus 256 and underneath additional portions 258.

Figure 20:
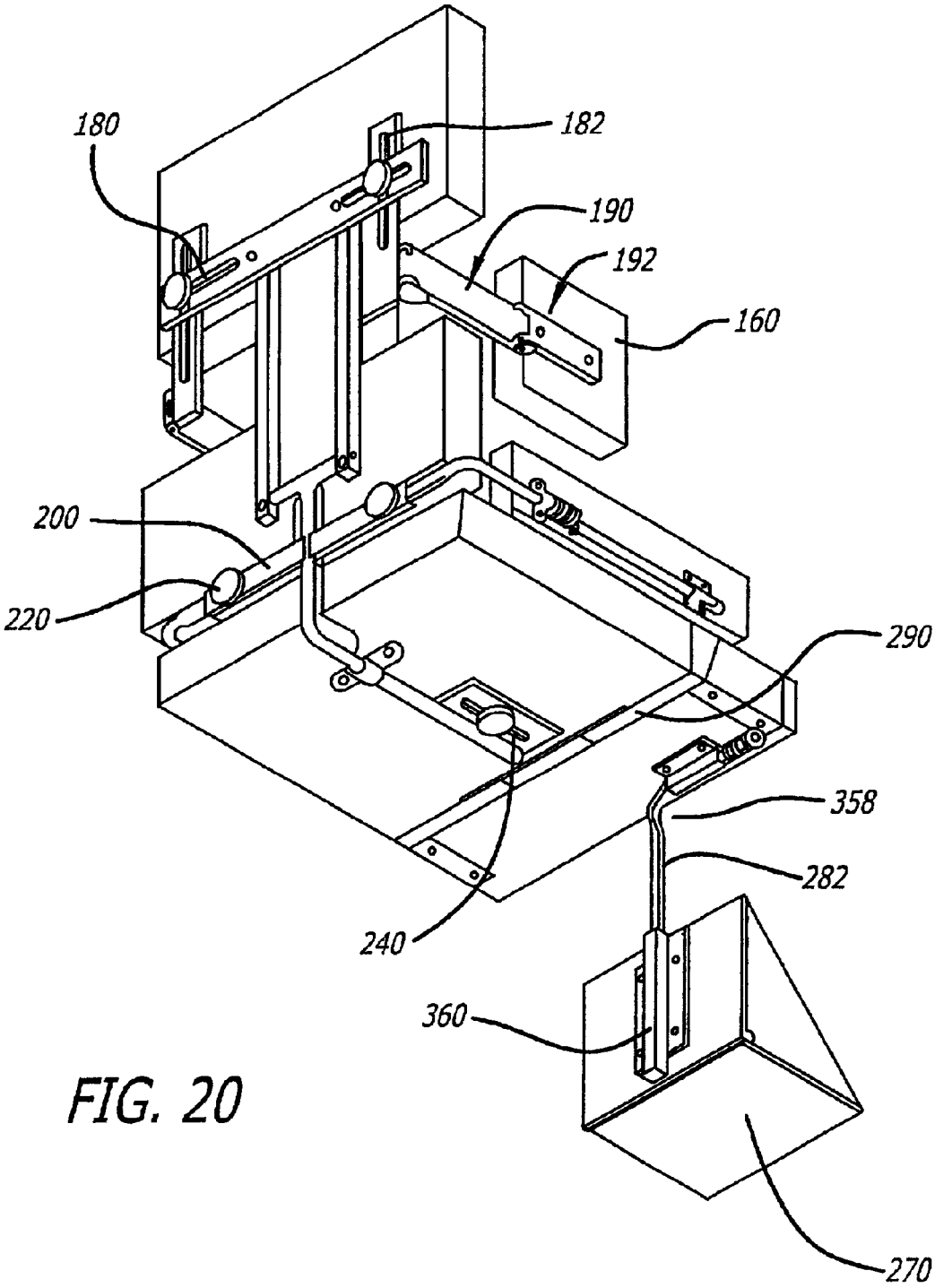
FIG. 20 is a rear perspective view of a seating arrangement according to the present invention, showing the bottom attachment configuration for the hip abductor embodiment of FIG. 19.

FIG. 20 shows an additional perspective view of the embodiment of FIG. 19 showing the attachment of the hip abductor apparatus 250 to the seat support 110. A hook and pile apparatus 290 is used to couple the hip abductor apparatus 250 to the seat support 110. Therefore, the hook and pile apparatus 290 serves as a hip abductor release mechanism 260. In this embodiment, the hip abductor apparatus 250 is adjustable according to the needs of a particular user by releasing the hook and pile apparatus 290 and reattaching the hook and pile apparatus 290 to the seat support 110 when the proper position has been achieved. It should also be noted from FIG. 20 that the vertical positioning of the foot support 270 is also adjustable by activating a footrest knob 360 and vertically positioning the foot support 270 along a foot support bar 358. The foot support release mechanism 280 may include a square tube 282 that receives the foot support bar 358 such that the tube 282 can be pulled against a spring 284 to allow the foot support 270 to fold or for horizontal extension according to the needs of a user.

Figure 21:
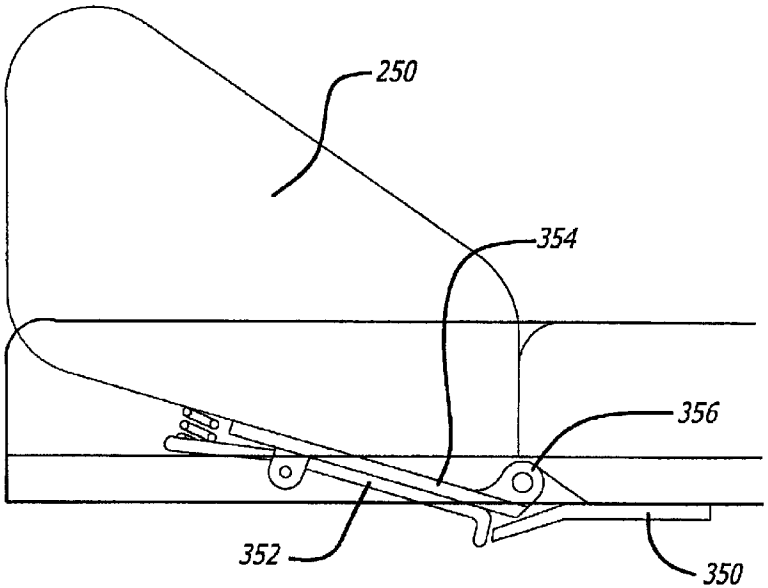
FIG. 21 is a side view of a hip abductor for use with a seating arrangement according to one embodiment of the present invention.
Figure 22:
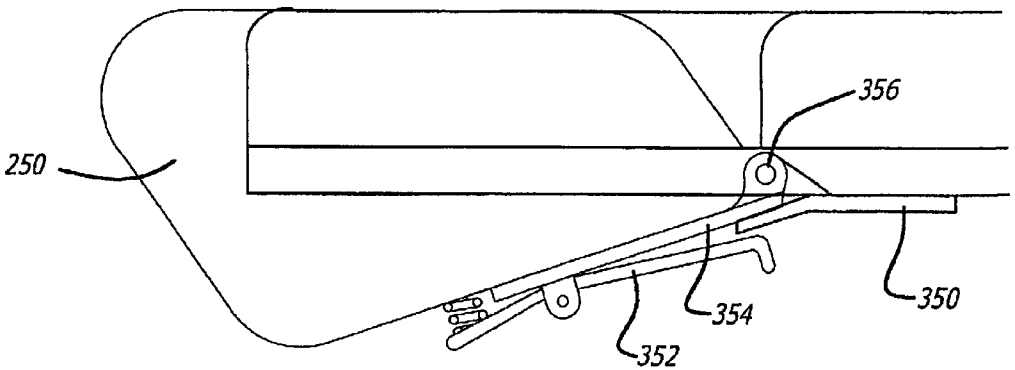
FIG. 22 is an additional side view of the hip abductor of FIG. 21.

FIG. 21 is a side view of a hip abductor apparatus 250 for use with a seating arrangement 100 according to one embodiment of the present invention. In this embodiment, the positioning of a first lever 350 and a second lever 352 determines whether the hip abductor apparatus 250 is in a raised or lowered position. In FIG. 21, the first lever 350 is shown positioned between a support bar 354 of the hip abductor apparatus 250 and the second lever 352. A rotational member 356 around which the hip abductor apparatus 250 moves is also included. FIG. 21 shows a relaxed position in which the hip abductor apparatus 250 is positioned in the same plane as the seat support 110. This allows the back support 130 to fold into a substantially parallel position relative to the seat support 110. FIG. 22 is an additional side view of the hip abductor apparatus 250 of FIG. 21. The first lever 350 and the second lever 352 are shown in different positions than that of FIG. 21. Here, an end of the first lever 350 contacts with an end of the second lever 352. This forces the second lever 352 to extend, causing the second lever 352 to move relative to the rotational member 356 and pushing the hip abductor apparatus 250 upward to extend above the seat support 110. This configuration is used for hip support for users of the seating arrangement 100.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A seating apparatus comprising:

a seat support in a first plane;

a back support in a second plane and coupled to, and configured to fold relative to, the seat support;

a plurality of side supports coupled to the back support, the plurality of side supports including:

lateral support means for providing a pair of lateral supports which are adjustable and capable of folding relative to the back support such that the pair of lateral supports are substantially positioned in the second plane, said lateral support means including a horizontal bracket extending along the upper portion of said back support and having a pair of spaced vertical brackets fixed thereto, said horizontal bracket having a pair of elongated horizontally extending slots, each of said vertical brackets having an elongated vertical slot, and lockable adjusting means extending through each of said slots in said horizontal bracket and into one of said slots in a respective one of said vertical brackets in adjustable locking relationship whereby said vertical brackets can be adjusted up and down and said horizontal bracket can be adjusted laterally; and pelvic support means for providing a pair of pelvic supports adjustable and capable of folding relative to the seat support such that the seat support and the pair of pelvic supports are substantially positioned in the first plane.

2. The seating apparatus of claim 1, further comprising a hip abductor coupled to the seat support.

3. The seating apparatus of claim 2, further comprising a hip abductor release mechanism, wherein the hip abductor is adjustable and foldable relative to the sear support by activating the hip abductor release mechanism.

4. The seating apparatus of claim 1, further comprising a seat support release mechanism coupled to the seat support and the back support, wherein a depth of the seat support relative to the back support is adjustable by activating the seat support release mechanism and moving the seat support to a desired seat depth.

5. The seating apparatus of claim 1, wherein the pelvic supports are extendable from a position in the first plane to a substantially perpendicular position relative to the seat support.

6. The seating apparatus of claim 1, wherein the distance between each pelvic support is adjustable by activating a pelvic support release mechanism and moving each pelvic support horizontally.

7. The seating apparatus of claim 6, wherein the pelvic supports are foldable by activating the pelvic support release mechanism.

8. The seating apparatus of claim 1, further comprising at least one foot rest coupled to the seat support.

9. A seating apparatus comprising:

a seat support in a first plane;

a back support in a second plane extending generally normal to said first plane and coupled to, and configured to hold the seat support;

a plurality of side supports coupled to the back support, the plurality of side supports including lateral support means for providing a pair of lateral supports which are adjustable and capable of folding relative to the back support such that the pair of lateral supports may be positioned substantially in the second plane to facilitate the folding of said back support and lateral support means to fold relative the seat support to a position whereby said lateral supports and said back support are disposed adjacent and generally parallel to said seat support in said first plane;

a seat support release mechanism coupled to the seat support and the back support, wherein a depth of the seat support relative to the back support is adjustable by activating the seat support release mechanism and moving the seat support to a desired seat depth; and a pair of lateral support release mechanisms, a pair of lateral support arms, and a plurality of brackets coupling the lateral support means to the back support, wherein each lateral support is coupled to a lateral support arm and a vertical bracket in the plurality of brackets, each of said lateral support arms being movable from a first position wherein said lateral support mounted thereon extends generally normal to the second plane to a second position wherein each said lateral support arm is folded into a position generally co-planar with said second plane.

10. The seating apparatus of claim 9, wherein the lateral supports are horizontally adjustable by activating the lateral support release mechanism and horizontally sliding a vertical bracket and a lateral support arm to a desired position.

* * * * *